United States Patent [19]

Walker

[11] Patent Number: 4,847,969

[45] Date of Patent: Jul. 18, 1989

[54] ROLL SPLITTER

[75] Inventor: John B. Walker, Escanaba, Mich.

[73] Assignee: The Mead Corporation, Dayton, Ohio

[21] Appl. No.: 145,847

[22] Filed: Jan. 19, 1988

[51] Int. Cl.[4] ..... B26F 3/00

[52] U.S. Cl. ..... 29/239; 225/93; 225/103

[58] Field of Search ..... 29/239, 413; 225/93, 225/103–105, 98

[56] References Cited

U.S. PATENT DOCUMENTS

| | | | |
|---|---|---|---|
| 2,537,464 | 1/1951 | Holmberg | 225/103 |
| 3,602,358 | 8/1971 | Jakobsson | 198/461 |
| 3,728,772 | 4/1973 | Coffman | 29/239 |
| 3,866,883 | 2/1975 | Goransson | 29/239 |
| 4,270,683 | 6/1981 | Crosby | 225/103 |
| 4,341,003 | 7/1982 | Kopena | 29/239 |
| 4,599,777 | 7/1986 | Michler | 29/239 |

*Primary Examiner*—Frank T. Yost

*Assistant Examiner*—Hien H. Phan

*Attorney, Agent, or Firm*—Smith & Schnacke

[57] ABSTRACT

A roll splitter for splitting apart rolls of paper that have been rewound onto separate cores positioned adjacent to each other on a common shaft such that adjacent edges of the rolls overlap. The roll splitter includes a vertically-extending, fixed post, a fixed base, a frame pivotably attached to the base, a pair of contact plates pivotably attached to the frame and being spaced apart from the post a distance sufficient to allow a roll of paper to be inserted therebetween and positioned on either side of the post, and a double-acting cylinder motor pivotably attached to the post and frame for pivoting the frame toward and away from the post. Two rolls having adjacent, overlapping edges are positioned between the post and the plates such that the overlapping edges are in registry with the post and are split apart as the cylinder motor urges the contact plates against the rolls, thereby urging the rolls against the post at the overlapping edges.

6 Claims, 3 Drawing Sheets

ROLL SPLITTER

BACKGROUND OF THE INVENTION

The present invention relates to roll splitters and, more particularly, to roll splitters for splitting apart relatively large diameter rolls of paper that have been rewound on a common shaft such that adjacent edges of the rolls overlap.

Paper frequently is manufactured and in relatively wide, large diameter rolls, but purchasers of such rolls typically need paper strips narrower than the purchased roll. Consequently, manufacturers and purchasers use slitting machines which receive the paper from a large width roll and slit the paper into a plurality of strips. The strips are then rewound onto separate cores positioned adjacent to each other on a common shaft. The rewound strips themselves form coils of narrower width which are positioned in abutting relation on the shaft, and frequently the abutting edges of adjacent rolls overlap, forming a connection between adjacent rolls which must be broken after the rolls and cores are removed from the shaft in order to separate the rolls.

One method of separating such rolls is to roll the joined rolls over a wedge such that an end roll is suspended slightly above the floor. A worker then inserts a pry bar into the center of the raised roll and exerts a downward force to split or separate that roll from an adjacent roll.

Another device for splitting rolls is disclosed in Crosby U.S. Pat. No. 4,270,683. That patent discloses a portable paper roll breaking machine which includes a lever and fulcrum mounted on a wheeled platform. One end of the lever is inserted into the center of a roll, and a spring-loaded ram urges an opposite end downwardly. The resultant upward force on the lever end within the roll urges that roll slightly upwardly, thereby separating it from its neighbor.

A disadvantage with such a device is that the amount of separating force which can be exerted by the lever is directly proportional to the size of the center opening of the roll to be separated; a relatively small diameter center opening would severely limit the size of the lever to be inserted therein. Another disadvantage is that the rapid movement of the lever arm, caused by the spring-loaded ram, presents a hazard to workers operating the device.

Accordingly, there is a need for a roll splitter which can exert a relatively high level splitting force and is not limited by the size of the opening in the roll center. There is also a need for a roll splitter which does not necessarily require a rapid-moving lever arm or the like which may present a hazard to an operator.

SUMMARY OF THE INVENTION

The present invention is a roll splitter which is specially designed to separate relatively large diameter paper rolls whose adjacent edges overlap each other and therefore form a friction connection between the rolls. The invention includes a vertically-extending, fixed post, a fixed base, a frame pivotably attached to the base to pivot toward and away from the post, first and second contact plates pivotably attached to the frame, and a double-acting cylinder motor pivotably attached to the post and frame. The contact plates are spaced from the post a distance sufficient to allow the joined rolls to be placed therebetween, and are positioned on either side of the post, preferably such that the post and plates form the apeces of an isosceles triangle.

In operation, two joined rolls which are to be split apart are positioned between the post and plates such that the seam to be split is adjacent to and in registry with the post. The double-acting cylinder is actuated to draw the frame, and hence the plates, toward the fixed post. The plates contact the outside surfaces of the joined rolls and urge the rolls against the post. Continued movement of the frame and plates causes the rolls to split apart at their overlapping edges; the double-acting cylinder is then actuated to pivot the frame away from the post and the rolls, now separated, are removed.

In a preferred embodiment, the fixed post includes a wedge-shaped saddle which is positioned at floor level, so that the rolls are lifted slightly from the floor when urged against the fixed post. This acts to transfer the splitting forces from the floor, or a floor conveyor supporting the rolls, to the post.

Accordingly, it is an object of the present invention to provide a roll splitter which is capable of handling rolls of a very large diameter and exerting large separating forces on such rolls, without need of inserting pry bars and the like into the center openings of the rolls; a roll splitter which does not need to impose a "shock" upon joined rolls in order to split them apart and therefore requires rapidly moving components; and a roll splitter which is relatively simple to operate and has little likelihood of jamming or fouling.

Other objects and advantages of the present invention will be apparent from the following description, the accompanying drawings and the appended claims.

DETAILED DESCRIPTION OF THE PREFERRED EMBODIMENT

Figure 1:
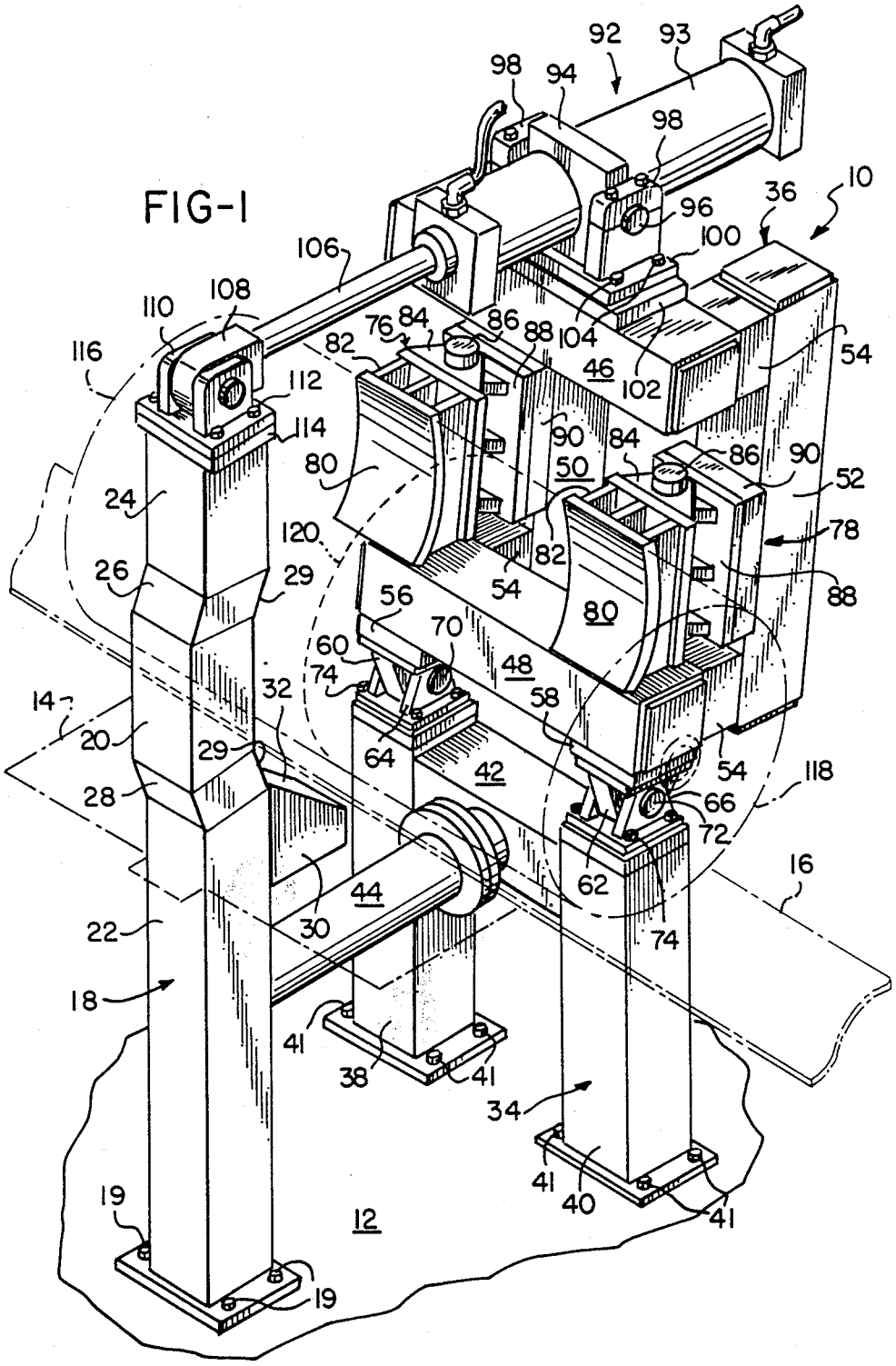
FIG. 1 is a somewhat schematic, perspective view of the roll splitter of the present invention, in which the rolls to be split, their supporting conveyor structure and floor are shown in phantom.

As shown in FIG. 1, the roll splitter of the present invention, generally designated 10, is designed to be mounted on a subfloor 12 below a shop floor 14. The shop floor 14 includes a chain conveyor 16 which extends through the splitter 10.

The roll splitter 10 includes a substantially vertically-extending post 18 mounted by bolts 19 to the subfloor 12. The post 18 is made of rectangular steel channel and includes an offset portion 20, a support post 22, post extension 24, and upper and lower connecting sections 26, 28 connecting the offset portion 20 to the post extension and support post, respectively. The connecting sections 26, 28 are angled outwardly such that each presents an inclined face 29. The support post 22 protrudes above the floor 14 and includes a wedge-shaped saddle 30 which is positioned to extend toward the center of the roll splitter 10 and present an inclined surface 32 above the floor.

The roll splitter 10 also includes a base 34 which supports a frame 36. The base 34 includes legs 38, 40 mounted by bolts 41 to the subfloor 12, and a cross brace 42 extending between the legs. The base 34 and support post 22 are joined by a transverse round channel 44 which extends beneath the floor 14 and provides a measure of rigidity to the roll splitter 10 and prevents relative movement between the support post and base.

Figure 5:
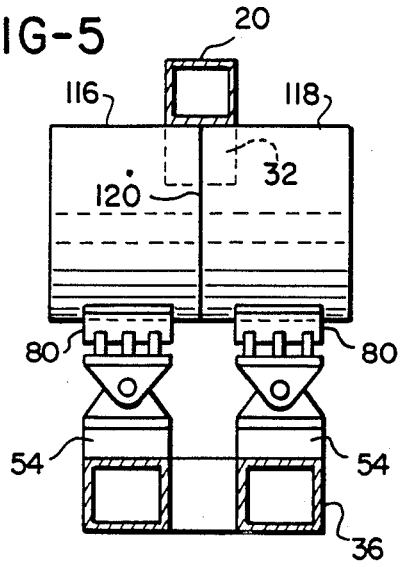
FIG. 5 is a detail showing a schematic plan view of the engagement of the joined rolls with the post and plates, in which the post and frame are in section.

The frame 36 includes upper and lower cross channels 46, 48, a pair of vertical channels 50, 52, and four spacer blocks 54 (see also FIG. 5). The spacer blocks join the upper and lower cross channels 46, 48 to the vertical channels 50, 52, thereby forming a rectangular structure.

The lower cross channel 48 includes mounting blocks 56, 58 which support knuckles 60, 62. The knuckles 60, 62 are pivotably attached to clevises 64, 66 by pins 70, 72. The clevises 64, 66 are mounted to the tops of the legs 38, 40 by bolts 74 so that the frame 36 is pivotable relative to the base 34.

Left and right contact plates assemblies 76, 78 are attached to the frame 36. Each of the contact plate assemblies 76, 78 includes an arcuate contact plate 80, a gusseted plate support 82, plate hinge blocks 84 and hinge pins 86. The plate hinge blocks 84 are pivotably attached by hinge pins 86 to frame hinge blocks 88, and hinge pads 90 attach the frame hinge blocks to the vertical channels 50, 52. The hinge pins 86 are oriented such that the arcuate plates 80 pivot about a substantially vertical axis. The arcuate plates 80 are shaped to have centers of curvature which lie along a common line that extends horizontally and coincides with the center of the rolls to be split.

A double-acting cylinder motor 92 includes cylinder 93 held in a collar 94 having sidewardly extending stubs 96 which are captured in pillow block bearings 98. The pillow block bearings 98 are mounted on a common plate 100 which, in turn, is bolted to a support 102 by bolts 104. The support 102 is mounted on the upper cross-channel 46 of the frame 36.

The piston rod 106 includes a knuckle 108 that is pivotably attached to a clevis 110 that, in turn, is attached by bolts 112 to an upper plate 114 of the post extension 24. Consequently, the cylinder motor 92 is pivotably attached to the frame 36 and the post 18. Extension and retraction of the piston rod 106 relative to the cylinder 93 causes the frame 36 to pivot about pins 70, 72 relative to the base 34. Pins 70, 72 are positioned such that the frame pivots toward and away from the post 18, thereby displacing the arcuate plates 80 toward and away from the post.

Figure 4:
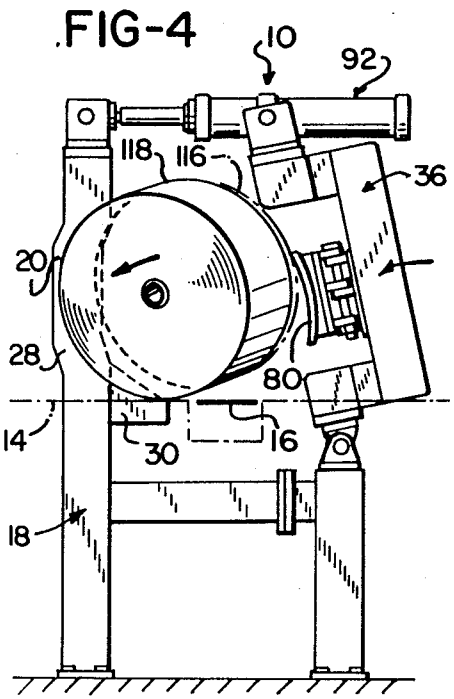
FIG. 4 is the side elevation of FIG. 2 in which the frame has been pivoted to split the rolls apart.
Figure 3:
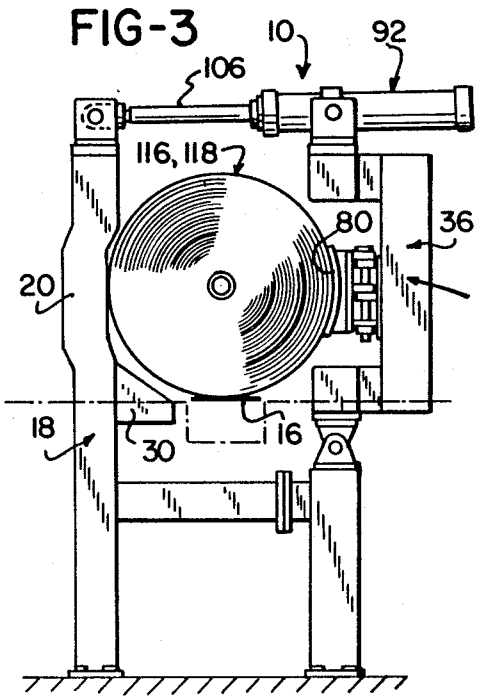
FIG. 3 is the side elevation of FIG. 2 in which the frame has been pivoted to bring the plates into contact with joined rolls.
Figure 2:
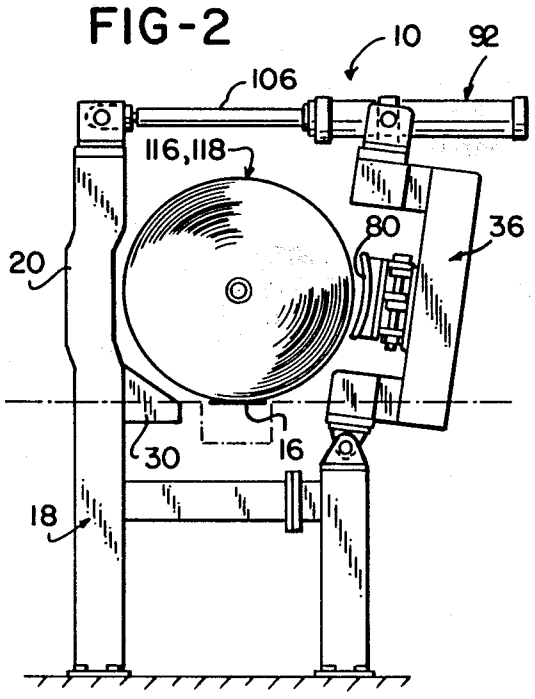
FIG. 2 is a schematic side elevation of the embodiment of FIG. 1 in which the frame has been pivoted away from the post to allow joined rolls to be inserted therebetween.

The operation of the roll splitter 10 is shown in FIGS. 2, 3 and 4, and is as follows. Rolls of paper 116, 118, which have been rewound onto cores on a common shaft, are removed from the shaft but have adjacent, overlapping edges forming a connection which must be broken in order to separate the rolls (see also FIG. 1). Rolls 116, 118 are transported by chain conveyor 16 to a position between post 18 and frame 36 where the seam 120 is in registry with the inclined surface 32 of the saddle 30 and the offset portion 20 of the post 18.

At this time, the rod 106 of the cylinder motor 92 is fully extended such that the frame 36 is pivoted away from the post 18 to provide sufficient clearance between the offset portion 20 and the plates 80 to allow the rolls 116, 118 to pass between them.

The splitting operation begins, as shown in FIGS. 3 and 5, when the double-acting cylinder motor 92 is actuated to retract the rod 106 into the cylinder 93, thereby pivoting the frame 106 toward the post 18. This brings the plates 80 into engagement with each of the rolls 116, 118, and displaces the rolls sidewardly from the conveyor 16 to the wedge 30 and offset portion 20.

Figure 6:
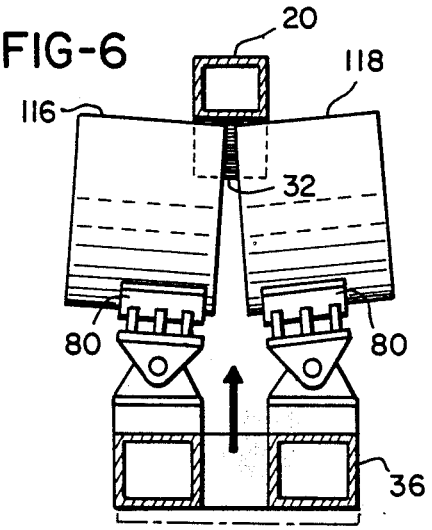
FIG. 6 is the schematic plan view of FIG. 5 in which the frame has been urged toward the post to split the rolls apart.

As shown in FIGS. 4 and 6, continued pivotal movement of the frame 36 causes the rolls 116, 118 to impinge upon the inclined surface 32 and offset portion 20 until the rolls are split apart. It should be noted that the splitting force imparted to the rolls 116, 118 by the plates 80 is not borne by either the chain conveyor 16 or the plates comprising the floor 14. Rather, the entire force, including the downward weight force of the rolls, is born either by the saddle 30 or the offset portion 20 of the post 18. Depending upon the geometry of the rolls to be split, in some instances the lower connecting section 28 may bear part of the load. However, in every case the splitting force imparted by the frame 36 is not transferred to the conveyor 16 or floor 14, thereby obviating the need for reinforcing the floor or conveyor.

As shown in FIG. 6, an advantage of the invention is provided by the pivotable connection between the plates 80 and the frame 36. This enables the plates to provide a splitting force that is substantially evenly distributed across the surface of the plates as the rolls are being split apart, since the plates can pivot to adjust to the changing orientation of the rolls as they split, relative to the frame 36. After the rolls 116, 118 have been split apart, they may be rolled back onto the chain conveyor 16 and removed from the splitter 10.

While the form of apparatus herein described constitutes a preferred embodiment of this invention, it is to be understood that the invention is not limited to this precise form of apparatus, and that changes may be made therein without departing from the scope of the invention.

What is claimed is:

1. A roll splitter for splitting apart two rolls of paper that have been rewound such that adjacent edges thereof overlap, thereby forming a connection therebetween, comprising:

means defining a fixed surface;

support means including first and second movable surfaces, said movable surfaces being spaced from said fixed surface sufficiently to allow a roll of paper to be inserted therebetween and positioned on opposite sides of said fixed surface; and means for displacing said movable surfaces toward and away from said fixed surface in paths such that said movable surfaces pass to either side of said fixed surface, whereby two rolls having adjacent, overlapping edges positioned between said fixed and movable surfaces such that said overlapping edges are in registry with said fixed surface are split apart as said displacing means urges said movable surfaces against said rolls, thereby urging said rolls against said fixed surface.

2. The roll splitter of claim 1 wherein said movable surfaces are pivotably connected to said support means.

3. The roll splitter of claim 1 wherein said support means includes a support base and a frame pivotably attached to said base for supporting said movable surfaces.

4. The roll splitter of claim 3 wherein said displacing means includes a double-acting cylinder motor extending between said frame and said fixed surface.

5. The roll splitter of claim 1 wherein said fixed surface includes a post having a width narrower than a total length of a pair of rolls to be split.

6. A roll splitter for splitting apart two rolls of paper that have been rewound such that adjacent edges thereof overlap, thereby forming a connection therebetween comprising:

a substantially vertically-extending, fixed post;

a fixed base;

a frame pivotably attached to said base to pivot toward and away from said post;

first and second contact plates pivotably attached to said frame to pivot about substantially vertical axes, said plates being spaced from said post a distance sufficient to allow a roll of paper to be inserted therebetween, and being positioned on either side of said post; and double-acting cylinder motor means pivotably attached to said post and said frame for pivoting said frame toward and away from said post such that said contact plates travel in paths to pass to either side of said post, whereby two rolls having adjacent overlapping edges positioned between said post and said plates such that said overlapping edges are in registry with said post are split apart as said cylinder motor means urges said contact plates against said rolls, thereby urging said rolls against said post.

* * * * *